US006591851B1

(12) United States Patent
Palten et al.

(10) Patent No.: US 6,591,851 B1
(45) Date of Patent: Jul. 15, 2003

(54) SEAL-GAS VALVE DEVICE

(75) Inventors: Thomas Palten, Kerpen (DE); Robert Stolle, Köln (DE); Dirk Kalisch, Düsseldorf (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 09/937,431

(22) PCT Filed: Jan. 20, 2000

(86) PCT No.: PCT/EP00/00409

§ 371 (c)(1),
(2), (4) Date: Sep. 26, 2001

(87) PCT Pub. No.: WO00/60276

PCT Pub. Date: Oct. 12, 2000

(30) Foreign Application Priority Data

Mar. 30, 1999 (DE) ..... 199 14 282

(51) Int. Cl.[7] ..... F16K 11/20

(52) U.S. Cl. ..... 137/12; 137/505.12; 137/601.18; 137/599.11; 137/565.13

(58) Field of Search ..... 137/599.04, 599.05, 137/599.09, 599.11, 601.18, 505.12, 12, 565.13; 251/118

(56) References Cited

U.S. PATENT DOCUMENTS

| | | | | | |
|---|---|---|---|---|---|
| 3,726,296 | A | * | 4/1973 | Friedland et al. | 137/1 |
| 3,905,394 | A | * | 9/1975 | Jerde | 137/599.04 |
| 4,256,100 | A | * | 3/1981 | Levy et al. | 128/204.21 |
| 4,498,496 | A | * | 2/1985 | Barcellona et al. | 137/599.04 |
| 5,456,281 | A | * | 10/1995 | Teay | 137/505.12 |
| 5,617,727 | A | * | 4/1997 | Zito | 62/55.5 |
| 5,663,487 | A | | 9/1997 | Widt | 73/1.26 |

FOREIGN PATENT DOCUMENTS

| | | |
|---|---|---|
| DE | 1941 669 | 5/1971 |
| DE | 24 08 256 | 9/1975 |
| DE | 24 08 257 | 9/1975 |

* cited by examiner

*Primary Examiner*—Stephen M. Hepperle
(74) *Attorney, Agent, or Firm*—Fay, Sharpe, Fagan, Minnich & McKee, LLP

(57) ABSTRACT

During the pumping of corrosive gases, it is advantageous to admit a seal gas to endangered pumping chambers at a lower flow rate and a higher pressure than the corrosive gases. Inert gas from a supply (3) has its pressure reduced by a pressure reducer (6). An on/off valve (7) controls a flow of the inert gas through a flow restriction (8) which restricts the flow of inert gas to appropriate sealing gas rates at an outlet (4). After pumping the corrosive gas, a control valve (12) in a bypass line (11) causes the inert gas to be supplied to the outlet (4) at a higher flow rate for purging the pump.

15 Claims, 1 Drawing Sheet

SEAL-GAS VALVE DEVICE

BACKGROUND OF THE INVENTION

The present invention relates to a valve device, equipped with a narrowed section which supplies a device with seal-gas.

When conveying aggressive gases with pumps there exists the problem that these gases enter into the motor chamber, bearing chamber or similar chambers where they give rise to corrosion. For the purpose of avoiding this problem it is known to continuously admit a seal-gas (inert gas, preferably nitrogen) into the endangered chambers at a pressure which is higher than the pressure of the gas being conveyed. Said seal-gas flows through the endangered chambers and prevents the entry of the detrimental gases.

From DE-A-2408256, for example, a turbomolecular vacuum pump having a motor chamber and a bearing chamber is known, into which a seal-gas is continuously admitted to protect the motor and the bearings. Through this means a significantly extended service life of the pump is attained. The chambers in need of protection detailed are supplied via valve devices (seal-gas valves) equipped with a narrowed section which are linked to a gas reservoir and where said valve devices shall maintain the desired seal-gas flow at a level between 0.2 and 1.2 mbar l/s, for example. Valve devices of this kind with an orifice as the narrowed section require very small orifice diameters, so that they will be prone to blockages. Moreover, their throughput is linearly dependent on the inlet pressure. When designing the narrowed section by way of a capillary the choice of greater diameters is possible; however, throughput increases according to the square of the inlet pressure. Finally it is known to employ control valves. However, at the low throughputs required here, these offer inferior control characteristics. Moreover, their operation is also dependent on the inlet pressure. The cause for variations in the inlet pressure is not only a gas reservoir being depleted; they will also occur if a multitude of chambers in need of a seal-gas supply—as common in modern vacuum systems serving, for example, the production of semiconductors—are connected to common gas reservoir drawing different quantities of seal-gas at different times.

It is the task of the present invention to create a valve device of the aforementioned kind which is cost-effective and which supplies a constant seal-gas flow over a wide range of inlet pressures.

SUMMARY OF THE INVENTION

This task is solved through the present invention by the characteristic features of the patent claims.

The pressure reducer positioned upstream of the narrowed section has the task of reducing the inlet pressure which for commonly employed seal-gas reservoirs may range up to 25 bar, to a fixed value of 0.2 to 2 bar, for example. As long as the pressure in the seal-gas reservoir does not drop below a fixed pressure level, the difference between the pressures ahead and after the narrowed section remains constant, i.e. the valve device according to the present invention supplies a constant seal-gas flow across a wide range of inlet pressures.

The narrowed section may be designed by way of a capillary or an orifice in a manner which is basically known. The design by way of a capillary is to be preferred so as to render the seal-gas valve less sensitive to contamination.

This may also or additionally be attained by a filter positioned upstream of the narrowed section, between pressure reducer and narrowed section, for example.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
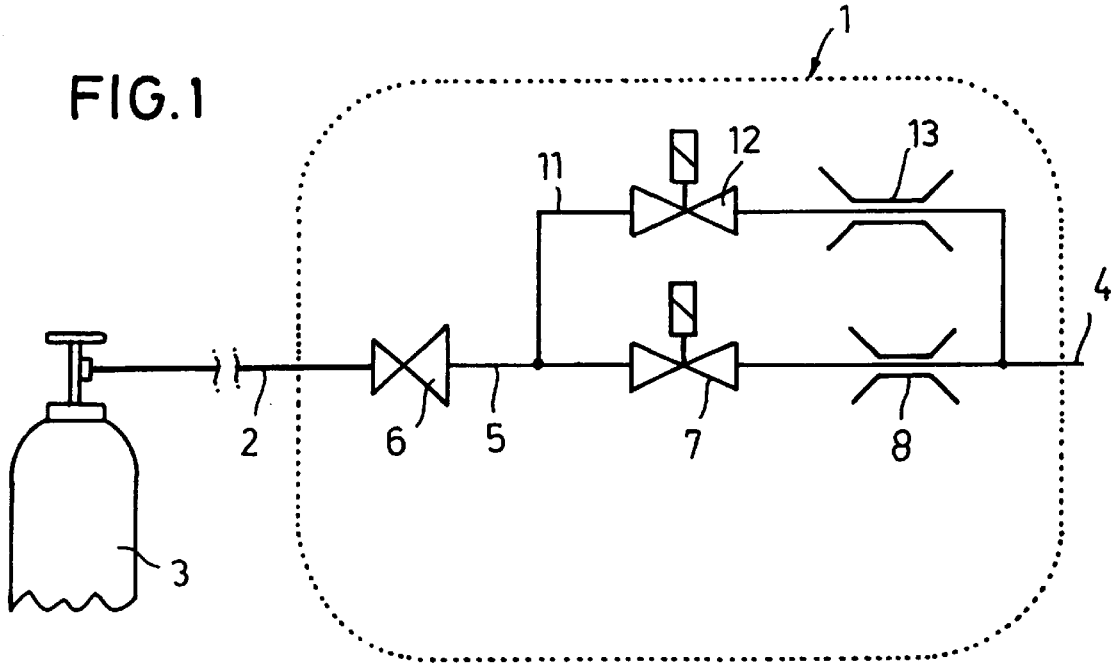
FIG. 1 is a diagrammatic illustration of an inert gas delivery system including a valve assembly in accordance with the present invention.

In the design examples according to drawing FIG. 1, there follows at the inlet 2 a line 5 with a pressure reducer 6, which may be implemented by way of an in-line pressure controller (company Aircom), for example. The pressure reducer is then followed downstream by a 2/2-way valve 7 through which the seal-gas operation can be switched on and off. Downstream of valve 7 there follows the narrowed section 8, designed by way of an orifice or a capillary. Positioned downstream of the narrowed section 8 there then follows the outlet of the valve device.

The line 5 is equipped with a bypass 11, bypassing the valve 7 and the narrowed section 8. The bypass 11 itself is equipped with a 2/2-way valve 12 and a narrowed section 13. The narrowed section 13 is so rated that with the gas flow passing and the valve 12 being open, a friction pump connected at the outlet 4 can be vented. The venting process causes the pump to be rapidly slowed down without causing any mechanical damage. Gas flows in the order of 10 to 80 mbar L/s are suited for this. Since the valves 7, 12 and the narrowed sections 8, 13 are located in parallel line sections, the presented valve device may be employed either as a seal-gas valve or as a vent valve.

Figure 2:
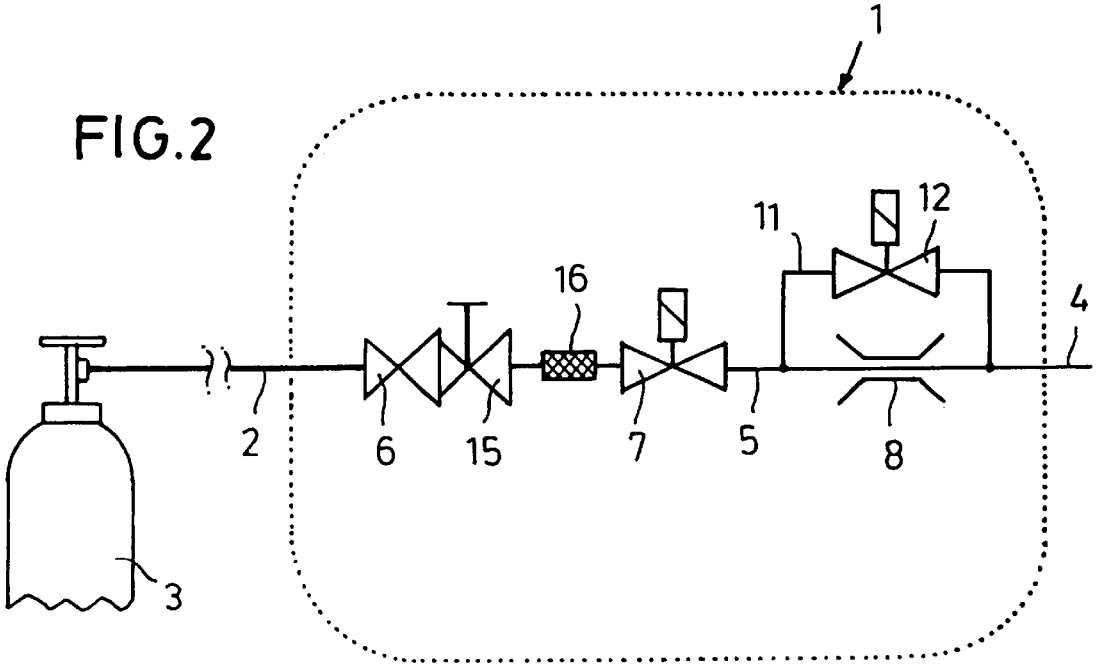
FIG. 2 is a diagrammatic illustration of a gas delivery system with an alternate embodiment of the valve assembly.

In the design example according to drawing FIG. 2 there follows downstream of pressure reducer 6 a second pressure reducer 15 which is adjustable, and which serves the purpose of fine adjusting the transfer pressure. Positioned downstream of the pressure reducers 6, 15 there follows a filter 16 to protect in particular the narrowed section 8 against contamination. This is followed by valve 7.

The bypass 11 only bypasses the narrowed section 8 so that the venting function can only be invoked provided both valves 7 and 12 are open. A separate narrowed section 13 in bypass 11 is not depicted. The bypass itself or a section thereof may take over the function of the narrowed section, provided their diameters are selected to be adequately small.

As already detailed, the narrowed section 8 is preferably a capillary since these may have relatively large diameters, the danger of clogging thus being small. Suitable capillaries are detailed in U.S. Pat. No. 5,663,487. These capillaries are plastic coated quartz capillaries which are equipped with a holder designed like a spray nozzle.

What is claimed is:

1. A device comprising:

a first narrowed section which supplies a friction vacuum pump with seal-gas;

a pressure reducer positioned between an inlet and the first narrowed section; and, a bypass which bypasses the first narrowed section, the bypass including a valve and a second narrowed section, the second narrowed section being so rated that it permits venting of the friction vacuum pump.

2. The device according to claim 1, wherein the first narrowed section is one of an orifice and a capillary.

3. The device according to claim 2, wherein the capillary is a plastic coated quartz capillary.

4. The device according to claim 1, wherein the first narrowed section is designed as a capillary and is equipped with a holder designed like a spray nozzle.

5. The device according to claim 1, wherein the first narrowed section is preceded by a filter.

6. The device according to claim 1, wherein the pressure reducer is adjustable.

7. The device according to claim 1, wherein the pressure reducer is an in-line pressure reducer.

8. The device according to claim 1, further including:

a second pressure reducer, the first pressure reducer being an in-line pressure reducer connected with the inlet and the second pressure reducer being for fine adjustment of the transfer pressure.

9. The device according to claim 8, further including:

a valve positioned between the pressure reducers and narrowed section.

10. A sealing gas delivery system for delivering sealing from an inert gas source to a turbomolecular vacuum pump for pumping corrosive gases to protect the turbomolecular pump's bearings and motor from corrosion, the system comprising:

an inlet connected with the inert gas source;

a pressure reducer connected with the inlet;

an on/off valve connected with the pressure reducer;

a flow restrictor means connected with the on/off valve for restricting flow of the inert gas to 0.2–1.2 mbar-liters per second; and, an outlet connected with the turbomolecular pump and with the flow restrictor means.

11. The system according to claim 10 wherein the pressure reducer reduces inert gas pressure to a range of 0.2–2.0 bar.

12. The system according to claim 10 further including:

a purging gas supply means which bypasses the flow restrictor means to supply the inert gas to the outlet at a flow of 10–80 mbar-liters/second.

13. The system according to claim 12 wherein the purging gas supply means includes:

a series connected on/off control valve and a flow restriction.

14. A method of supplying an inert sealing gas from an inert gas supply to a pump for pumping corrosive gases, the method comprising:

reducing a pressure of the inert gas to a range of 0.2 to 2 bar;

after reducing the pressure of the inert gas, valving the reduced pressure inert gas on and off;

when the reduced pressure inert gas is valved on, restricting flow of the inert gas to 0.2–1.2 mbar liter/sec to provide a sealing gas flow;

supplying the 0.2–1.2 mbar liter/sec sealing gas flow of inert gas to the pump.

15. The method according to claim 14 further including:

restricting the reduced pressure inert gas to 10–80 mbar liter/sec to provide a purging gas flow;

supplying the 10–80 mbar liter/sec purging gas flow to the pump.

* * * * *